US007266863B2

(12) United States Patent
Lu

(10) Patent No.: US 7,266,863 B2
(45) Date of Patent: Sep. 11, 2007

(54) RETRACTABLE HANDLE ASSEMBLY FOR LUGGAGE

(75) Inventor: Lien-Ching Lu, Miaoli Hsien (TW)

(73) Assignee: Theprem Success Co., Ltd, Miaoli Hsien (TW)

( * ) Notice: Subject to any disclaimer, the term of this patent is extended or adjusted under 35 U.S.C. 154(b) by 211 days.

(21) Appl. No.: 11/086,693

(22) Filed: Mar. 22, 2005

(65) Prior Publication Data

US 2006/0213029 A1 Sep. 28, 2006

(51) Int. Cl.
*A45C 7/00* (2006.01)

(52) U.S. Cl. ..... 16/113.1

(58) Field of Classification Search ..... 16/113.1, 16/429, 405; 190/115, 18 A; 280/655, 655.1, 280/47.315, 47.371
See application file for complete search history.

(56) References Cited

U.S. PATENT DOCUMENTS 5,367,743 A * 11/1994 Chang ..... 16/113.1
5,692,266 A * 12/1997 Tsai ..... 16/113.1
6,026,543 A * 2/2000 Chen ..... 16/113.1
6,128,806 A * 10/2000 Shou-Mao ..... 16/113.1
6,226,834 B1 * 5/2001 Lu ..... 16/113.1
6,357,080 B1 * 3/2002 Tsai ..... 16/113.1
6,668,423 B1 * 12/2003 Chen ..... 16/113.1
2004/0016614 A1 * 1/2004 Chou ..... 190/115

FOREIGN PATENT DOCUMENTS

FR 2418729 A * 11/1979
JP 11075925 A * 3/1999

* cited by examiner

*Primary Examiner*—Chuck Y. Mah
(74) *Attorney, Agent, or Firm*—Alan Kamrath; Kamrath & Associates PA

(57) ABSTRACT

A retractable handle assembly for a luggage includes an outer pipe, an intermediate pipe, an inner pipe, and a control handle. Each of the inner pipe and the intermediate pipe has a bottom end provided with a support seat and a locking device. The support seat includes a housing and an end cap. The locking device includes at least one press member, at least one locking pin, and at least one positioning pin. Thus, the inner pipe and the intermediate pipe are positioned exactly and stably so that the inner pipe and the intermediate pipe will not slip when the retractable handle assembly is folded and expanded, thereby facilitating a user operating the retractable handle assembly.

11 Claims, 7 Drawing Sheets

PRIRO ART

PRIRO ART

RETRACTABLE HANDLE ASSEMBLY FOR LUGGAGE

BACKGROUND OF THE INVENTION

1. Field of the Invention

The present invention relates to a multi-stage retractable handle assembly for a luggage, and more particularly to a retractable handle assembly having a locking and positioning effect.

2. Description of the Related Art

A conventional retractable handle assembly 10 for a luggage in accordance with the prior art shown in FIGS. 8 and 9 comprises a handle 11 having two ends each provided with an outer pipe 14, an intermediate pipe 13 movably mounted in the outer pipe 14 and having a plurality of locking holes 131, an inner pipe 12 movably mounted in the intermediate pipe 13, and a link 121 pressed by the handle 11 and extended into the inner pipe 12. Each of the inner pipe 12 and the intermediate pipe 13 has a bottom end provided with a locking device 15 including a fixing seat 151, a locking pin 153 movably mounted in the fixing seat 151 and having a first end detachably locked in one of the locking holes 131 of the intermediate pipe 13, an elastic member 154 mounted in the fixing seat 151 and biased between the fixing seat 151 and a second end of the locking pin 153 to push the locking pin 153 toward the respective locking hole 131 of the intermediate pipe 13, and a V-shaped control member 152 pivotally mounted in the fixing seat 151 and having a first end rested on a lower end of the link 121 and a second end locked on the second end of the locking pin 153.

However, when the locking pin 153 of the locking device 15 attached on the inner pipe 12 is locked in the respective locking hole 131 of the intermediate pipe 13, the locking pin 153 of the locking device 15 attached on the intermediate pipe 13 is movable in the outer pipe 14, so that the intermediate pipe 13 is not positioned in the outer pipe 14 and easily slips in the outer pipe 14 when the retractable handle assembly 10 is folded. In addition, the locking pin 153 of the locking device 15 is usually made of a metallic material to withstand a larger force, so that the locking pin 153 of the locking device 15 rubs the outer pipe 14 and the intermediate pipe 13 during movement of the outer pipe 14 and the intermediate pipe 13, thereby producing greater noise.

SUMMARY OF THE INVENTION

The primary objective of the present invention is to provide a retractable handle assembly having a locking and positioning effect.

Another objective of the present invention is to provide a retractable handle assembly for a luggage, wherein the inner pipe and the intermediate pipe are positioned exactly and stably so that the inner pipe and the intermediate pipe will not slip when the retractable handle assembly is folded and expanded, thereby facilitating a user operating the retractable handle assembly.

A further objective of the present invention is to provide a retractable handle assembly for a luggage, wherein the second end of the locking pin is provided with a noise depression cap to provide a noise depression effect to depress noise produced when the locking pin rubs the intermediate pipe or the outer pipe, thereby preventing from producing noise when the retractable handle assembly is folded and expanded.

Further benefits and advantages of the present invention will become apparent after a careful reading of the detailed description with appropriate reference to the accompanying drawings.

DETAILED DESCRIPTION OF THE INVENTION

Figure 1:
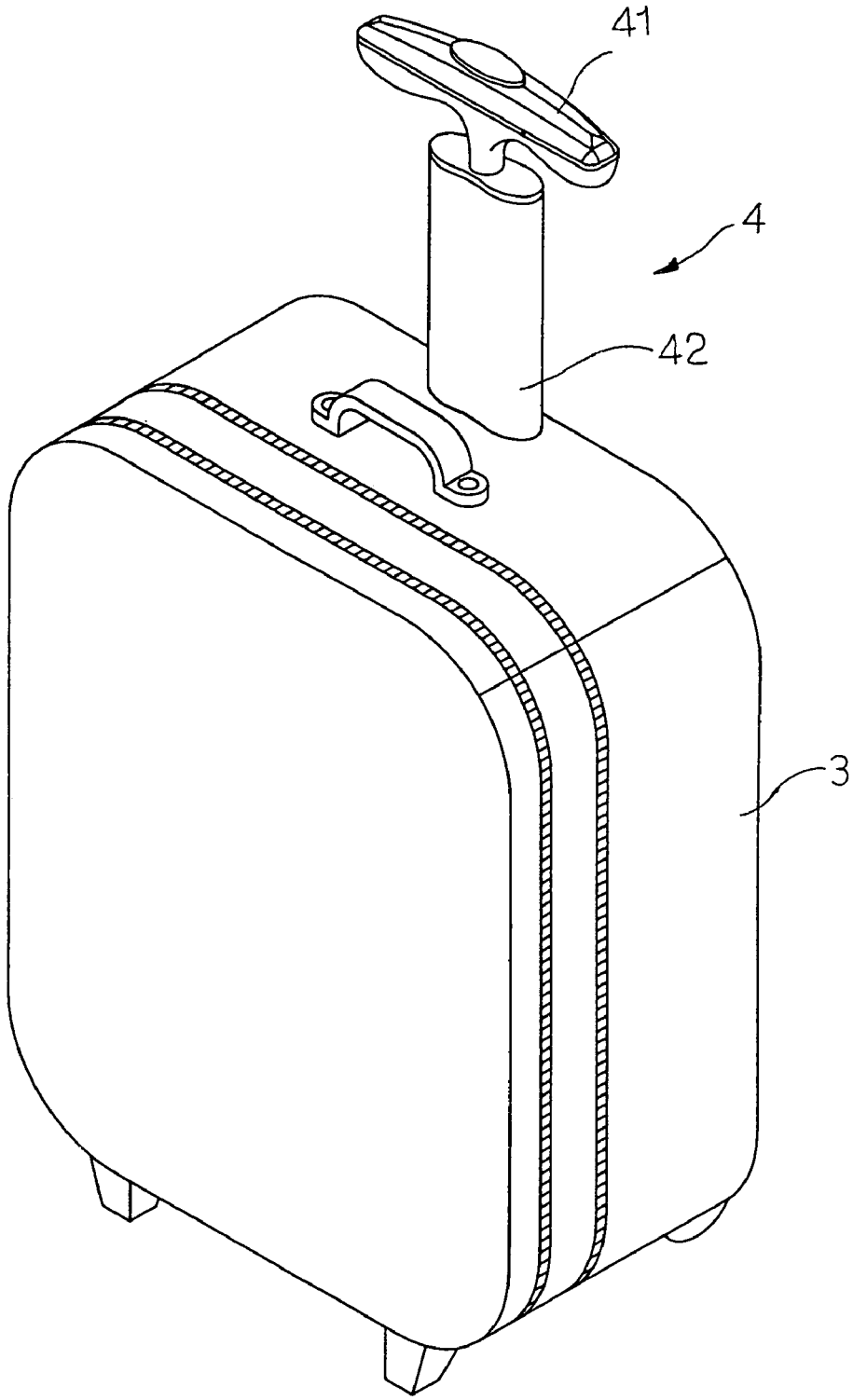
FIG. 1 is a perspective view of a retractable handle assembly for a luggage in accordance with the preferred embodiment of the present invention.

Referring to the drawings and initially to FIGS. 1-5, a retractable handle assembly 4 in accordance with the preferred embodiment of the present invention is mounted on for a luggage 3 and comprises an outer pipe 44 having a plurality of locking holes 441 and having a bottom end formed with at least one positioning hole 442, an intermediate pipe 43 movably mounted in the outer pipe 44 and having a plurality of locking holes 432, an inner pipe 42 movably mounted in the intermediate pipe 43, and a control handle 41 movably mounted on the inner pipe 42 and having at least one link 411 (see FIG. 6) extended into the inner pipe 42.

Figure 2:
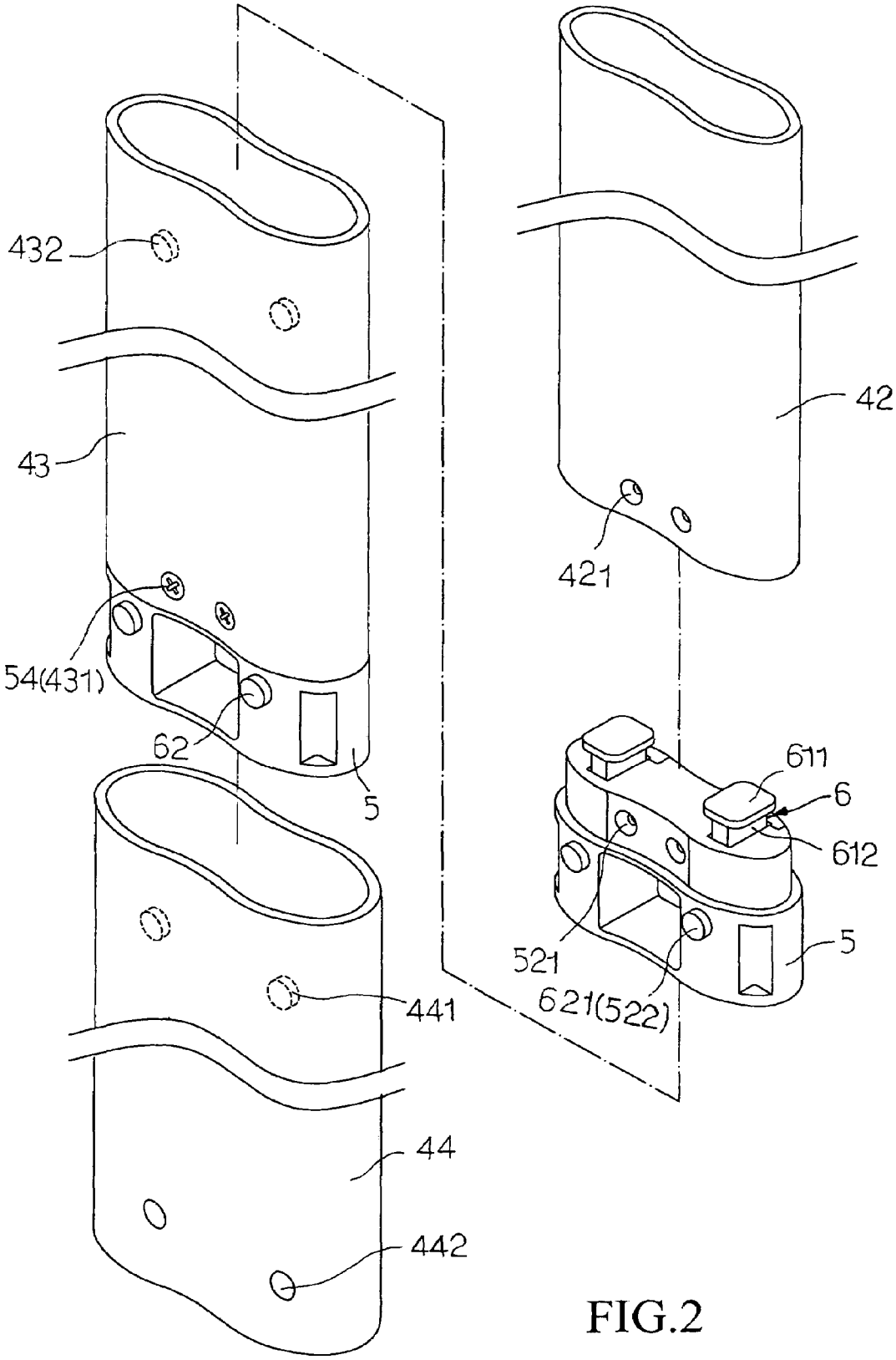
FIG. 2 is a partially exploded perspective view of the retractable handle assembly as shown in FIG. 1.
Figure 3:
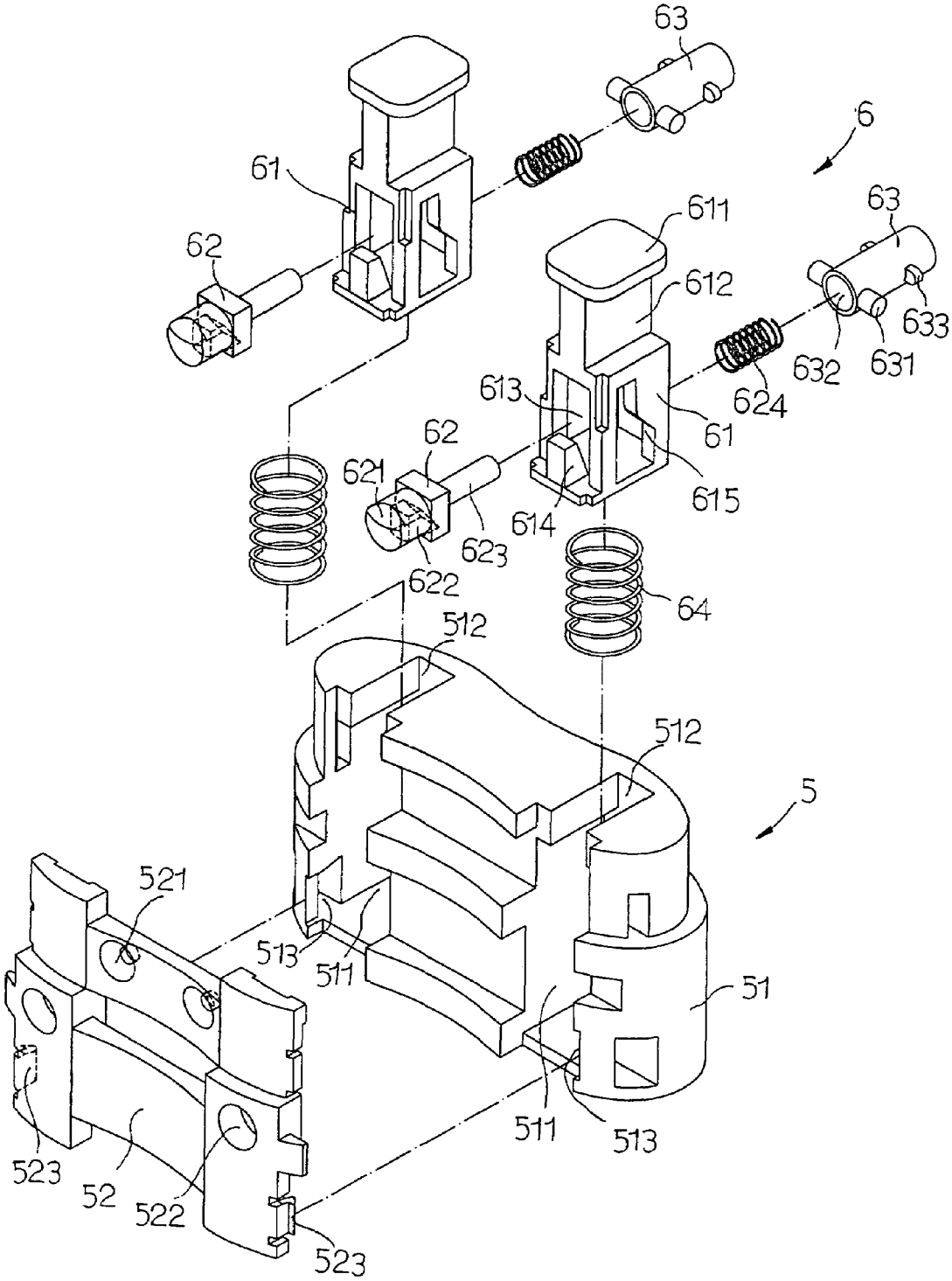
FIG. 3 is an exploded perspective view of the retractable handle assembly as shown in FIG. 1.

Each of the inner pipe 42 and the intermediate pipe 43 has a bottom end provided with a support seat 5 and a locking device 6 as shown in FIG. 2. The bottom end of each of the inner pipe 42 and the intermediate pipe 43 is formed with at least one through bore 421 and 431.

The support seat 5 includes a housing 51, and an end cap 52 secured on the housing 51.

The housing 51 of the support seat 5 has an inside formed with at least one limit recess 511 having a top end formed with a stop edge 512. The housing 51 of the support seat 5 has a surface formed with at least one through hole 514 (see FIG. 4). The housing 51 has a periphery formed with a plurality of locking recesses 513.

The end cap 52 of the support seat 5 has a surface formed with at least one through hole 522 aligning with the through hole 514 of the housing 51. The end cap 52 of the support seat 5 has a periphery formed with a plurality of locking hooks 523 locked in the locking recesses 513 of the housing 51 to lock the end cap 52 secured on the housing 51. The end cap 52 of the support seat 5 has an end formed with at least one screw bore 521 and provided with at least one locking screw 54 (see FIG. 2) which is extended through the through bore 421 and 431 of each of the inner pipe 42 and the intermediate pipe 43 and screwed into the screw bore 521 so that the support seat 5 is secured to each of the inner pipe 42 and the intermediate pipe 43.

The locking device 6 is mounted on the support seat 5 and includes at least one press member 61, at least one restoring spring 64, at least one locking pin 63, at least one positioning pin 62, and at least one elastic member 624.

The press member 61 of the locking device 6 is movably mounted in the limit recess 511 of the housing 51 and has an inside formed with a receiving chamber 613 for receiving the locking pin 63 and the positioning pin 62 and having an end provided with a tapered push block 614 and two sides each formed with a tapered push slot 615. The press member 61 of the locking device 6 has a top end provided with an enlarged press button 611 protruded outward from the housing 51 of the support seat 5 and connected to the link 411 of the control handle 41 and a mediate portion formed with a reduced neck 612 limited by the stop edge 512 of the housing 51.

The restoring spring 64 of the locking device 6 is mounted in the limit recess 511 of the housing 51 and biased between a bottom end of the press member 61 and the housing 51 of the support seat 5 to push the press member 61 upward relative to the housing 51 of the support seat 5.

Figure 4:
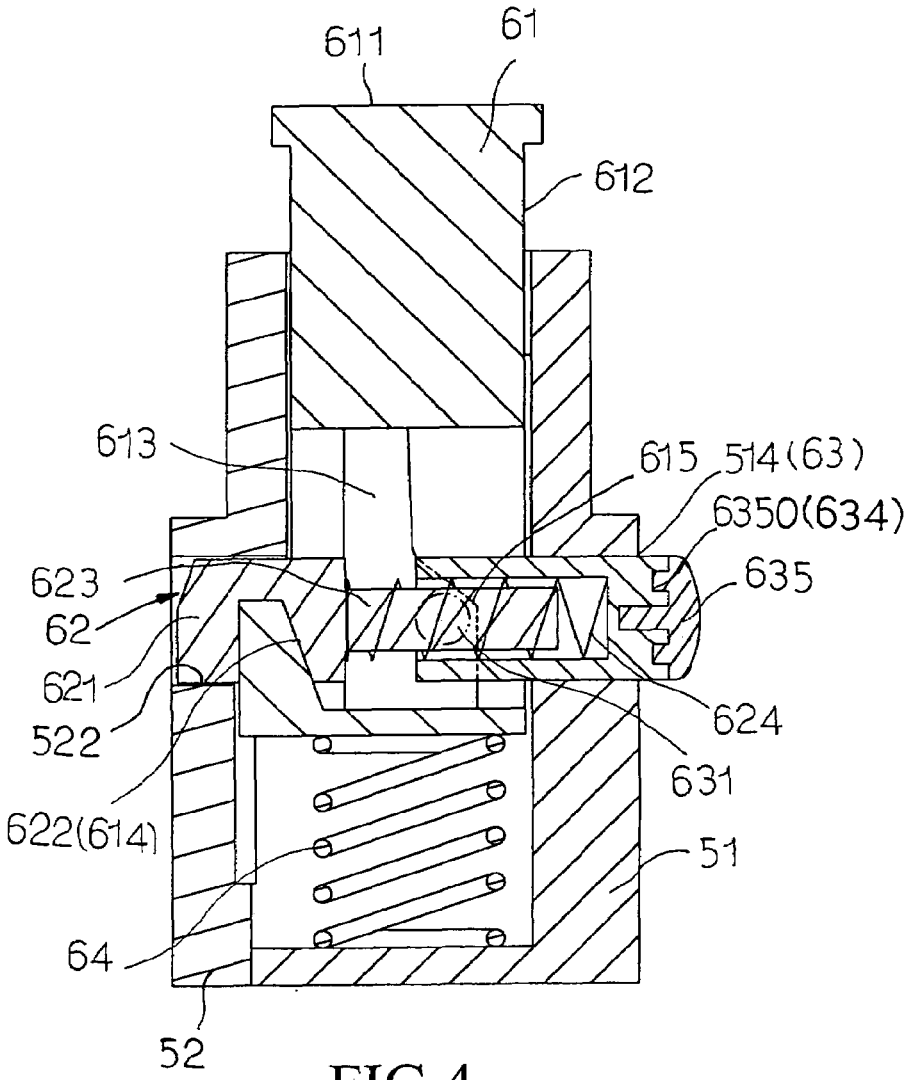
FIG. 4 is a side plan cross-sectional assembly view of the retractable handle assembly as shown in FIG. 2.
Figure 5:
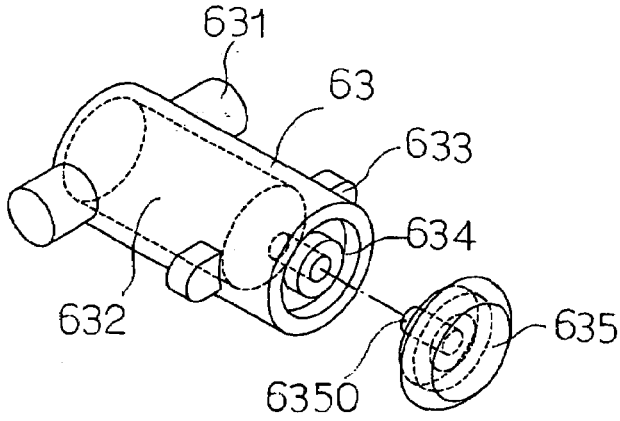
FIG. 5 is a partially exploded perspective view of the retractable handle assembly as shown in FIG. 3.

The locking pin 63 of the locking device 6 is retractably mounted in the through hole 514 of the housing 51 and has an inside formed with a mounting recess 632. The locking pin 63 of the locking device 6 has a first end provided with two outwardly protruding urging posts 631 each rested on the respective tapered push slot 615 of the press member 61 and a second end protruded outward from the through hole 514 of the housing 51 as shown in FIG. 4 and detachably locked in one of the locking holes 432 of the intermediate pipe 43 or one of the locking holes 441 of the outer pipe 44. The second end of the locking pin 63 is provided with two outwardly protruding limit stubs 633 protruded outward from the press member 61. The second end of the locking pin 63 has an end face provided with a noise depression cap 635 to provide a noise depression effect. The end face of the second end of the locking pin 63 is formed with an aperture 634, and the noise depression cap 635 has a side formed with a stud 6350 locked in the aperture 634 of the locking pin 63 so that the noise depression cap 635 is fixed on the locking pin 63.

The positioning pin 62 of the locking device 6 is retractably mounted in the through hole 522 of the end cap 52 and has a first end formed with a tapered slide slot 622 mounted on the tapered push block 614 of the press member 61 and a second end formed with a positioning stub 621 retractably protruded outward from the through hole 522 of the end cap 52 and detachably locked in the positioning hole 442 of the outer pipe 44. The second end of the positioning pin 62 is provided with a limit rod 623 extended into the mounting recess 632 of the locking pin 63.

The elastic member 624 is mounted on the limit rod 623 and biased between the positioning pin 62 and the locking pin 63 to push the locking pin 63 and the positioning pin 62 outward relative to each other.

Figure 6:
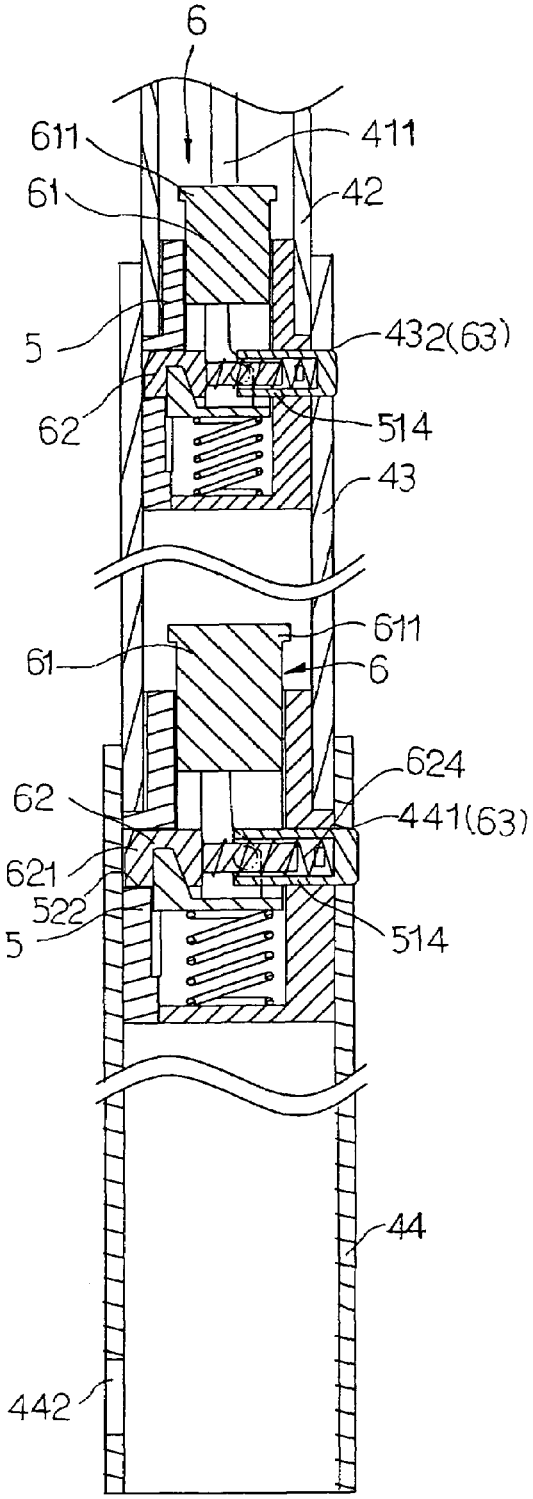
FIG. 6 is a side plan cross-sectional assembly view of the retractable handle assembly as shown in FIG. 2.
Figure 7:
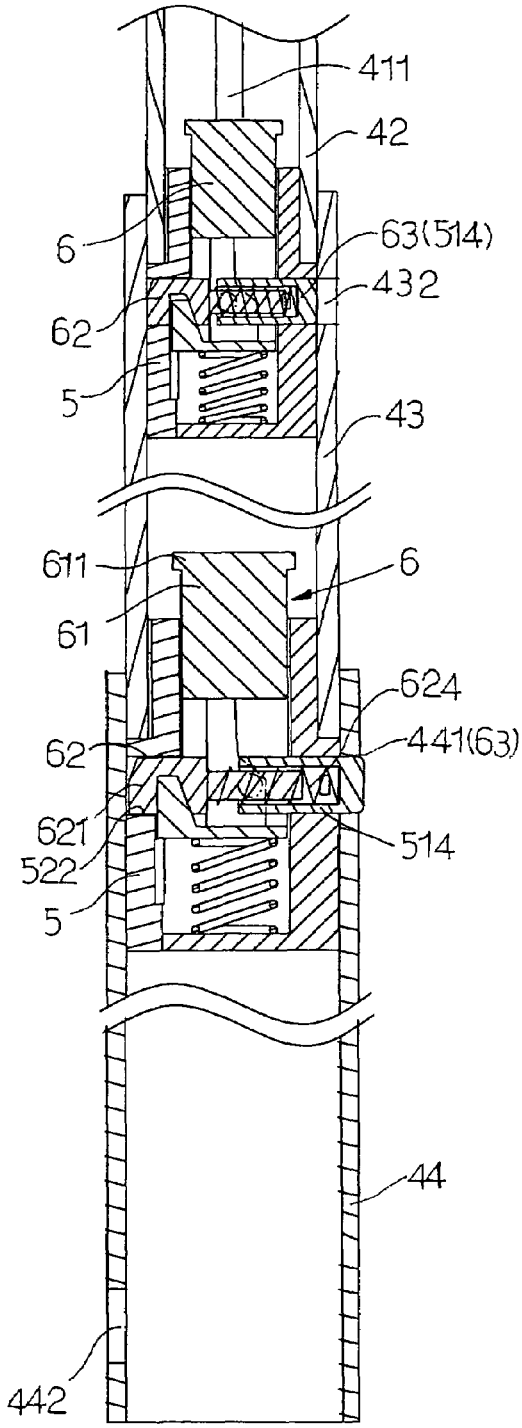
FIG. 7 is a schematic operational view of the retractable handle assembly as shown in FIG. 6 in use.
Figure 8:
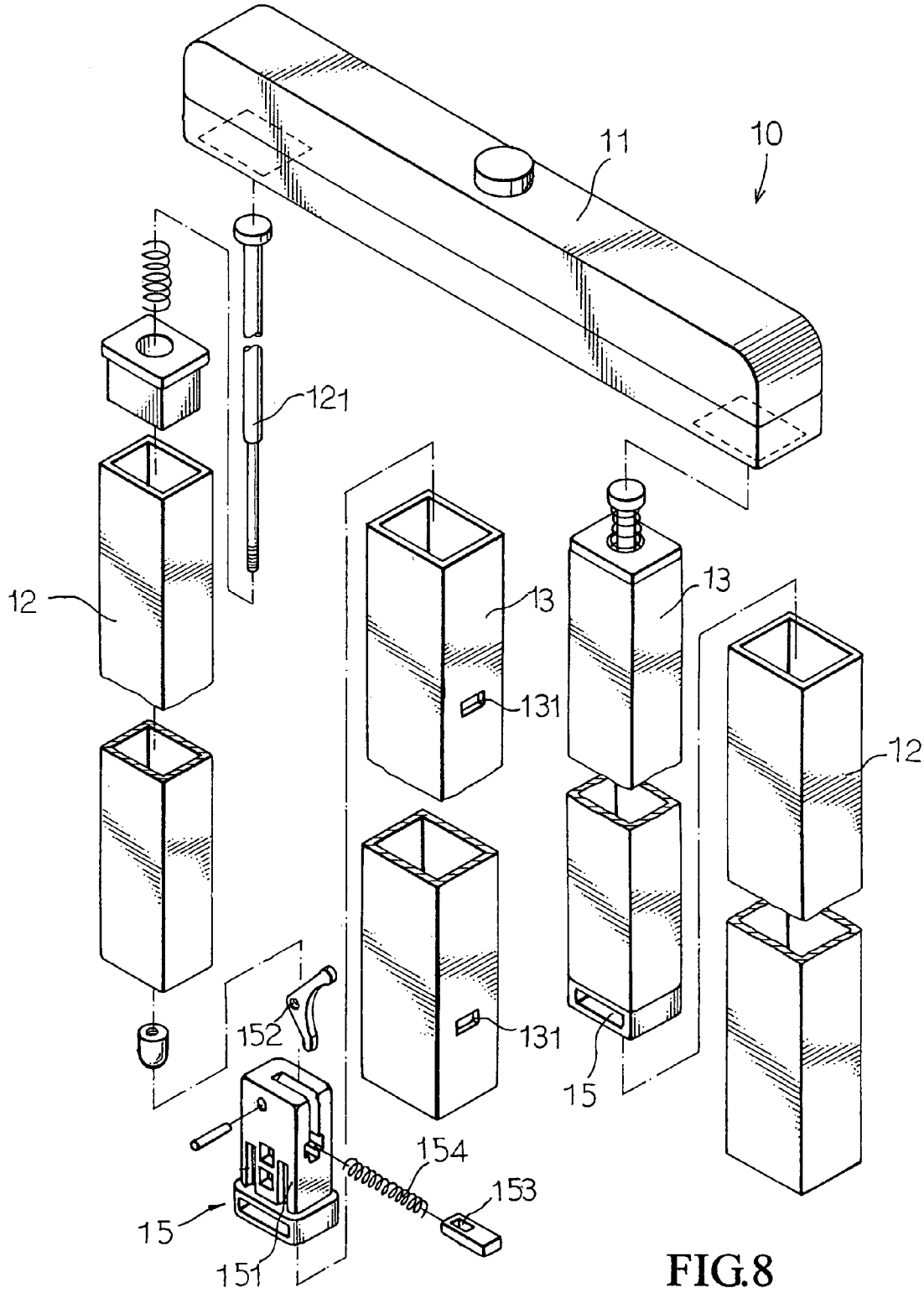
FIG. 8 is a partially exploded perspective cross-sectional view of a conventional retractable handle assembly for a luggage in accordance with the prior art.
Figure 9:
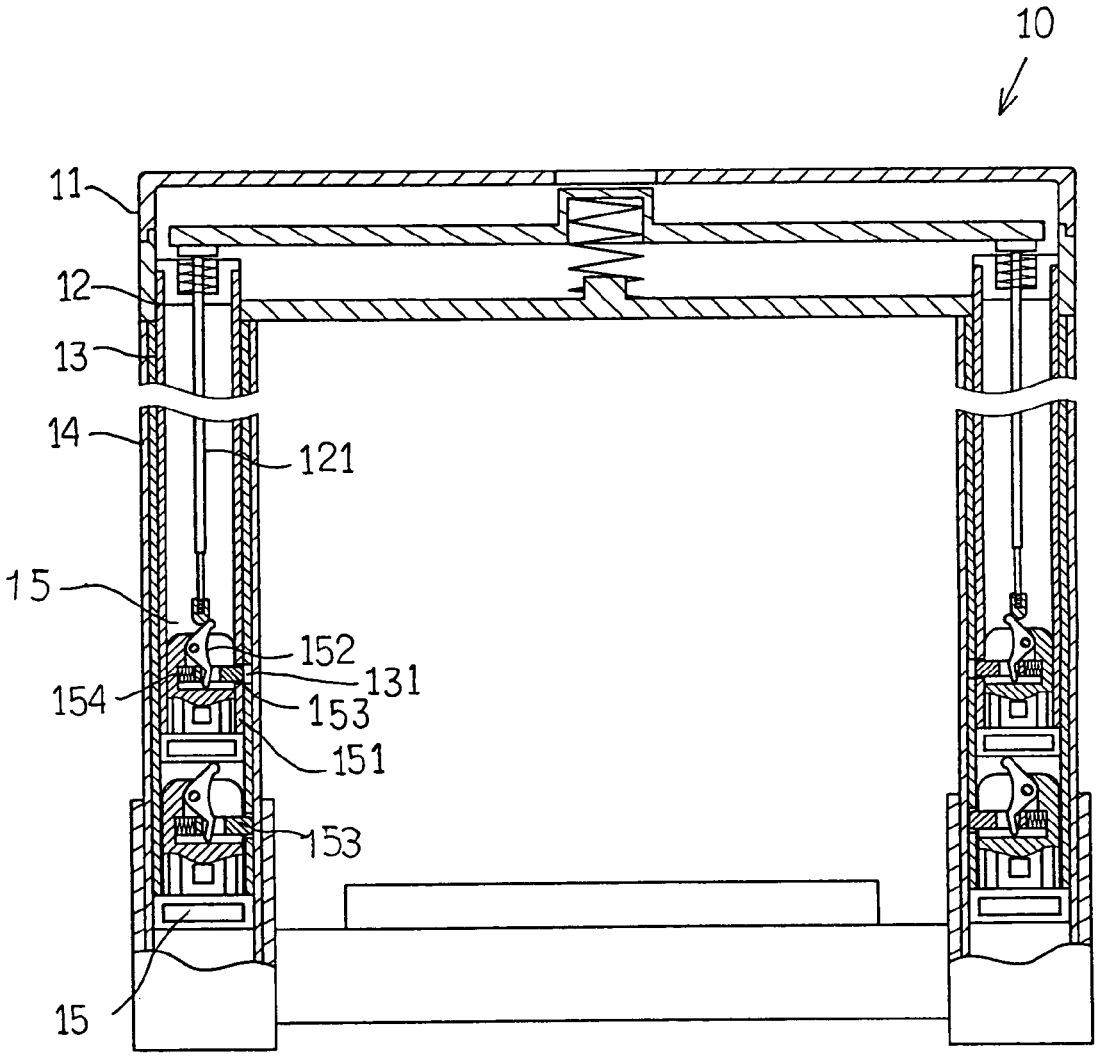
FIG. 9 is a plan cross-sectional assembly view of the conventional retractable handle assembly in accordance with the prior art.

In operation, referring to FIGS. 1-7, when the control handle 41 is pressed downward, the link 411 of the control handle 41 is moved downward to press the press button 611 of the press member 61 of the locking device 6 attached on the bottom end of the inner pipe 42, so that the press member 61 is movable downward in the limit recess 511 of the housing 51. When the press member 61 is moved downward, the tapered push slots 615 of the press member 61 are moved downward to push the urging posts 631 of the locking pin 63 to move transversely so as to drive the locking pin 63 to move inward. Thus, the locking pin 63 is moved from the position as shown in FIG. 6 to the position as shown in FIG. 7, so that the second end of the locking pin 63 is detached from a first locking hole 432 of the intermediate pipe 43 and retracted into the through hole 514 of the housing 51. Thus, the inner pipe 42 is movable in the intermediate pipe 43.

When the inner pipe 42 is moved to the bottom end of the intermediate pipe 43, the housing 51 of the support seat 5 attached on the bottom end of the inner pipe 42 presses the press button 611 of the press member 61 of the locking device 6 attached on the bottom end of the intermediate pipe 43, so that the press member 61 is movable downward in the limit recess 511 of the housing 51. When the press member 61 is moved downward, the tapered push slots 615 of the press member 61 are moved downward to push the urging posts 631 of the locking pin 63 to move transversely so as to drive the locking pin 63 to move inward. Thus, the locking pin 63 is moved to a position where the second end of the locking pin 63 is detached from the respective locking hole 441 of the outer pipe 44 and retracted into the through hole 514 of the housing 51. Thus, the intermediate pipe 43 is movable in the outer pipe 44.

At this time, the locking pin 63 of the locking device 6 attached on the bottom end of the inner pipe 42 is pushed outward by the restoring force of the elastic member 624 so that the second end of the locking pin 63 is moved to protrude outward from the through hole 514 of the housing 51 and is locked in a second locking hole 432 of the intermediate pipe 43, thereby fixing the inner pipe 42 in the intermediate pipe 43.

When the intermediate pipe 43 is moved to the bottom end of the outer pipe 44, the positioning pin 62 of the locking device 6 attached on the bottom end of the intermediate pipe 43 is pushed outward by the restoring force of the elastic member 624 so that the positioning stub 621 of the positioning pin 62 is moved to protrude outward from the through hole 522 of the end cap 52 and is locked in the positioning hole 442 of the outer pipe 44, thereby fixing the intermediate pipe 43 in the outer pipe 44.

Thus, when the retractable handle assembly 4 is folded, the inner pipe 42 is fixed in the intermediate pipe 43, the intermediate pipe 43 is fixed in the outer pipe 44, and the outer pipe 44 is fixed in the luggage 3, so that the retractable handle assembly 4 is folded closely, thereby preventing the inner pipe 42 and the intermediate pipe 43 from slipping freely.

Alternatively, When the user wishes to expand the retractable handle assembly 4, the control handle 41 is pressed to drive the link 411 of the control handle 41 to move downward to press the press button 611 of the press member 61 of the locking device 6 attached on the bottom end of the inner pipe 42, so that the press member 61 is movable downward in the limit recess 511 of the housing 51. When the press member 61 is moved downward, the tapered push slots 615 of the press member 61 are moved downward to push the urging posts 631 of the locking pin 63 to move transversely so as to drive the locking pin 63 to move inward. Thus, the locking pin 63 is moved to a position where the second end of the locking pin 63 is detached from the second locking hole 432 of the intermediate pipe 43 and retracted into the through hole 514 of the housing 51, thereby unlocking the inner pipe 42 from the intermediate pipe 43. Thus, the inner pipe 42 is movable in the intermediate pipe 43.

Then, the inner pipe 42 is moved upward in the intermediate pipe 43 until the second end of the locking pin 63 is aligned with the first locking hole 432 of the intermediate pipe 43 as shown in FIG. 7. At this time, the locking pin 63 of the locking device 6 attached on the bottom end of the inner pipe 42 is pushed outward by the restoring force of the elastic member 624 so that the second end of the locking pin 63 is moved to protrude outward from the through hole 514 of the housing 51 and is locked in the first locking hole 432 of the intermediate pipe 43 as shown in FIG. 6, thereby fixing the inner pipe 42 in the intermediate pipe 43 again.

In addition, after the housing 51 of the support seat 5 attached on the bottom end of the inner pipe 42 is detached from the press button 611 of the press member 61 of the locking device 6 attached on the bottom end of the intermediate pipe 43, the downward force applied on the press member 61 is removed, so that the press member 61 is pushed by the restoring force of the elastic member 64 to move upward in the limit recess 511 of the housing 51. Thus, the tapered push block 614 of the press member 61 is moved upward to push the tapered slide slot 622 of the positioning pin 62 sideward to drive the positioning pin 62 to move transversely so as to drive the positioning pin 62 to move inward, so that the positioning stub 621 of the positioning pin 62 is moved to detach from the positioning hole 442 of the outer pipe 44 and retract into the through hole 522 of the end cap 52, thereby unlocking the intermediate pipe 43 from the outer pipe 44. Thus, the intermediate pipe 43 is movable in the outer pipe 44. Then, the inner pipe 42 and the intermediate pipe 43 are moved upward in the outer pipe 44, thereby fully expanding the retractable handle assembly 4.

At this time, when the intermediate pipe 43 is moved to a position where the second end of the locking pin 63 is aligned with the respective locking hole 441 of the outer pipe 44, the locking pin 63 is pushed outward by the restoring force of the elastic member 624 so that the second end of the locking pin 63 is moved to protrude outward from the through hole 514 of the housing 51 and is locked in the respective locking hole 441 of the outer pipe 44 as shown in FIG. 6, thereby fixing the inner pipe 42 in the outer pipe 44 again.

Accordingly, the inner pipe 42 and the intermediate pipe 43 are positioned exactly and stably so that the inner pipe 42 and the intermediate pipe 43 will not slip when the retractable handle assembly 4 is folded and expanded, thereby facilitating a user operating the retractable handle assembly 4. In addition, the second end of the locking pin 63 is provided with a noise depression cap 635 to provide a noise-depression effect to depress noise produced when the locking pin 63 rubs the intermediate pipe 43 or the outer pipe 44, thereby preventing from producing noise when the retractable handle assembly 4 is folded and expanded.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A retractable handle assembly, comprising:

an outer pipe having a plurality of locking holes and having a bottom end formed with at least one positoning hole;

an intermediate pipe movably mounted in the outer pipe and having a plurality of locking holes;

an inner pipe movably mounted in the intermediate pipe;

a control handle movably mounted on the inner pipe and having at least one link extended into the inner; wherein each of the inner pipe and the intermediate pipe has a bottom end provided with a support seat and a locking device;

the support seat includes a housing, and an end cap secured on the housing;

the housing of the support seat has an inside formed with at least one limit recess and has a surface formed with at least one through hole;

the end cap of the support seat has a surface formed with at least one through hole aligning with the through hole of the housing;

the locking device is mounted on the support seat and includes at least one press member, at least one locking pin, and at least one positioning pin;

the press member of the locking device is movably mounted in the limit recess of the of the housing and has an inside formed with a receiving chamber having an end provided with a tapered push block and two sides each formed with a tapered push slot;

the press member of the locking device proviede on the inner pipe has a top end provided with an enlarged press buttom protruded outward from the housing of the support seat and connected to the link of the control handel;

the locking pin of the locking device is retracably mounted in the through hole of the housing and has a first end provided with two outwardly protruding urging post each rested on the respective tapered push slot of the press member and a second end protruded outward from the through hole of the housing;

the locking pin the locking device has an inside formed with a mounting recess;

the positioning pin of the locking device is retractably mounted in the through hole of the end cap and has a first end formed with a tapered slide slot mounted on the tapered push block of the press member and a second end formed with a positioning stub retractably protruded outward from the through hole of the end cap;

the second end of the positioning pin is provided with a limit rod extended into the mounting recess of the locking pin;

the locking device further includes at least one elastic member mounted on the limit rod and biased between the positioning pin and the locking run to push the locking pin and the positioning pin outward relative to each other;

the locking device further includes at least one restoring spring mounted in the limit recess of the housing and biased between a bottom end of the press member and the housing of the support seat to push the press member upward relative to the housing of the support seat.

2. The retractable handle assembly in accordance with claim 1, wherein the receiving chamber of the press member receives the locking pin and the positioning pin.

3. The retractable handle assembly in accordance with claim 1, wherein the limit recess of the housing has a top end formed with a stop edge, and the press member of the locking device has a mediate portion formed with a reduced neck limited by the stop edge of the housing.

4. The retractable handle assembly in accordance with claim 1, wherein the second end of the locking pin is detachably lockable in one of the locking holes of the intermediate pipe.

5. The retractable handle assembly in accordance with claim 1, wherein the second end of the locking pin is detachably lockable in one of the locking holes of the outer pipe.

6. The retractable handle assembly in accordance with claim 1, wherein the second end of the locking pin is provided with two outwardly protruding limit stubs protruded outward from the press member.

7. The retractable handle assembly in accordance with claim 1, wherein the second end of the locking pin has an end face provided with a noise depression cap to provide a noise depression effect.

8. The retractable handle assembly in accordance with claim 7, wherein the end face of the second end of the locking pin is formed with an aperture and the noise depression cap has a side formed with a stud locked in the aperture of the locking pin so that the noise depression cap is fixed on the locking pin.

9. The retractable handle assembly in accordance with claim 1, wherein the positioning stub of the positioning pin is detachably locked in the positioning hole of the outer pipe.

10. The retractable handle assembly in accordance with claim 1, wherein the housing has a periphery formed with a plurality of locking recesses, and the end cap of the support seat has a periphery formed with a plurality of locking hooks locked in the locking recesses of the housing to lock the end cap secured on the housing.

11. The retractable handle assembly in accordance with claim 1, wherein the bottom end of each of the inner pipe and the intermediate pipe is formed with at least one through bore, and the end cap of the support seat has an end formed with at least one screw bore and provided with at one locking screw which is extended through the through bore of each of the inner pipe and the intermediate pipe and screwed into the screw bore so that the support seat is secured to each of the inner pipe and the intermediate pipe.

* * * * *